US008240547B2

(12) United States Patent
Stow, III et al.

(10) Patent No.: US 8,240,547 B2
(45) Date of Patent: Aug. 14, 2012

(54) OCTAGONAL CONTAINERS

(75) Inventors: Franklin P. Stow, III, Torrance, CA (US); Kin Hang George Wong, New Territories (HK)

(73) Assignee: Mattel, Inc., El Segundo, CA (US)

( * ) Notice: Subject to any disclaimer, the term of this patent is extended or adjusted under 35 U.S.C. 154(b) by 1027 days.

(21) Appl. No.: 12/196,736

(22) Filed: Aug. 22, 2008

(65) Prior Publication Data

US 2009/0050681 A1 Feb. 26, 2009

Related U.S. Application Data

(63) Continuation-in-part of application No. PCT/US2007/010978, filed on May 4, 2007.

(60) Provisional application No. 60/915,866, filed on May 3, 2007, provisional application No. 60/797,780, filed on May 4, 2006.

(51) Int. Cl.
*B65D 5/00* (2006.01)

(52) U.S. Cl. ..... 229/109; 229/162.6; 206/776

(58) Field of Classification Search ..... 229/109, 229/162.6, 162.7, 93; 206/776, 782
See application file for complete search history.

(56) References Cited

U.S. PATENT DOCUMENTS 1,892,714 A * 1/1933 Wellman ..... 229/109
2,122,480 A * 7/1938 Lowey ..... 229/212
2,540,707 A * 2/1951 Beukelman ..... 47/72
2,587,828 A 3/1952 Fogel
2,649,807 A 8/1953 Ritter
2,744,622 A 5/1956 Sparks
2,791,367 A 5/1957 Mefford
2,845,976 A 8/1958 Miller
2,980,242 A 4/1961 Miller
3,040,878 A 6/1962 De Kolb
3,057,466 A 10/1962 Blonder et al.
3,310,219 A 3/1967 Dlugopolski
3,333,685 A * 8/1967 Pezdek ..... 206/728
3,406,816 A * 10/1968 Green et al. ..... 446/73
3,481,453 A 12/1969 Beichler et al.
D217,131 S 4/1970 Shreve et al.
3,533,503 A 10/1970 Keats et al.
3,627,541 A 12/1971 Farquhar
3,708,103 A 1/1973 Evans
3,940,009 A 2/1976 Szeles et al.
3,945,561 A 3/1976 Strebelle et al.
3,949,933 A 4/1976 Giambrone et al.
3,991,932 A 11/1976 Curren et al.
D244,259 S 5/1977 Bergstein
D244,981 S 7/1977 Austin
4,083,454 A 4/1978 O'Neill
4,099,648 A 7/1978 Kirkton
4,129,211 A 12/1978 Clement et al.

(Continued)

*Primary Examiner* — Steven A. Reynolds
*Assistant Examiner* — King M Chu
(74) *Attorney, Agent, or Firm* — Panitch Schwarze Belisario & Nadel LLP

(57) ABSTRACT

Octagonal container assemblies to package and display of products, particularly toys with moving wheels, appendages or the like to demonstrate movement of the same in the container, include a tubular body and at least two octagonal end covers removable or at least pivotal away from opposing ends of the tubular body. The container assemblies include a beam extended between the end covers and a rigid support member extended transversely from the beam so as to support the toy for at least limited operation or the wheels or the like within the container. The beam may be inserted in the container or extend along its exterior.

17 Claims, 7 Drawing Sheets

U.S. PATENT DOCUMENTS 4,463,997 A 8/1984 Densen
4,509,645 A 4/1985 Hotta et al.
4,533,065 A 8/1985 Chazal et al.
4,562,922 A 1/1986 Midura
4,606,461 A 8/1986 Bolton, Sr.
4,828,929 A 5/1989 Pierson
5,076,526 A 12/1991 Zane et al.
5,083,670 A 1/1992 Zimmer
5,183,177 A 2/1993 Yu et al.
5,193,701 A 3/1993 Bush et al.
5,197,659 A 3/1993 Vassiliou
5,273,206 A 12/1993 Vassiliou
5,375,700 A 12/1994 Joss et al.
5,429,261 A 7/1995 Machino et al.
5,447,230 A 9/1995 Gerondale
D367,226 S 2/1996 Ransbottom
5,544,619 A 8/1996 Braun et al.
5,593,087 A * 1/1997 Ross et al. ..... 229/199
5,778,594 A 7/1998 Askins et al.
5,813,523 A * 9/1998 Gnadt et al. ..... 206/77.1
5,868,306 A 2/1999 Wen-Tsan et al.
5,871,099 A 2/1999 Mellenthin et al.
5,913,474 A 6/1999 Chu
5,996,885 A 12/1999 Chu
6,003,708 A 12/1999 Meyering et al.
6,015,057 A 1/2000 Stone et al.
6,041,998 A 3/2000 Goldberg et al.
6,042,527 A 3/2000 Anderson et al.
6,149,025 A 11/2000 Wang et al.
D436,313 S 1/2001 Joshua et al.
D442,084 S 5/2001 Hoffman et al.
6,244,439 B1 6/2001 Dennis
6,273,246 B1 8/2001 Marciano
6,332,554 B1 12/2001 McCarthy et al.
D464,881 S 10/2002 Weinstein et al.
D464,882 S 10/2002 Weinstein et al.
6,474,541 B1 11/2002 Chu
D468,636 S 1/2003 Weinstein et al.
D471,450 S 3/2003 Gehring et al.
D479,992 S 9/2003 Gehring et al.
6,622,867 B2 9/2003 Menceles
6,688,516 B1 2/2004 Ussen
6,726,019 B2 4/2004 Leung
D498,673 S 11/2004 Weiss
6,851,551 B2 2/2005 Lemaire
6,857,521 B2 2/2005 Cantu-Gonzalez
6,868,964 B2 3/2005 Carty et al.
6,926,152 B2 8/2005 Leung
7,000,775 B2 2/2006 Gelardi et al.
7,044,305 B2 5/2006 Girondi et al.
D555,471 S 11/2007 Lebras et al.
D556,566 S 12/2007 Steele, IV et al.
2002/0008517 A1 1/2002 Derby et al.
2002/0074256 A1 6/2002 Koeman
2003/0155271 A1 8/2003 Menceles
2004/0007487 A1 1/2004 Cantu-Gonzalez
2005/0218036 A1 10/2005 Ahn
2005/0284782 A1 12/2005 Nago
2006/0042975 A1 3/2006 Izen et al.
2006/0219593 A1 10/2006 Linz

* cited by examiner

OCTAGONAL CONTAINERS

CROSS-REFERENCE TO RELATED APPLICATIONS

This Application is a non-provisional of application of U.S. Provisional Patent Application 60/915,866 filed on May 3, 2007; U.S. Provisional Patent Application 60/797,780 filed May 4, 2006; and is a continuation-in-part of International Patent Application PCT/US2007/010978 filed May 4, 2007 all of which are incorporated by reference herein.

BACKGROUND OF THE INVENTION

Toy containers are well known. It is believed that a new toy container with an unusual appearance and capability for storing a mechanically active toy like a remote controlled (R/C) toy while simultaneously allowing functional operation of the stored toy would provide more engaging play and on-the-shelf display activity than previous toys stored within their containers.

SUMMARY OF THE INVENTION

According to one aspect of the invention, an octagonal container comprises an main tubular portion having opposing open ends; a pair of octagonal shaped end covers configured to be received on the open ends so as to close the open ends; a rigid beam member extended between the pair of octagonal end covers along a side of the elongated tubular portion so as to provide a large central open area within the elongated tubular portion; and a rigid support member extended transversely from the rigid beam member into the large central open area within the elongated tubular portion.

In another aspect, the invention is a single sheet of foldable stock material configured to form an octagonal container comprising eight planar panels in consecutive side by side relation, each of the panels being rectangular with a pair of opposing major edges and a pair of opposing minor edges extending between the major edges, each consecutive pair of planar panels sharing common major edges defined by a fold line between the pair of planar panels, a closure tab adjoining one outer panel of the eight planar panels in side by side relation, the one outer panel and the closure tab sharing common major edges defined by a fold line between the one outer panel and the closure tab; a first end panel extending from the minor edge of one of the eight planar panels, along one side of the eight planar panels; and a second end panel extending from the minor edge of one of the eight planar panels, along another side of the eight planar panels opposing the one side with the first end panel, wherein each of the first and second end panels comprises an octagonal central portion with eight consecutive perimeter edges, each of the central portions being surrounded by a plurality of tabs, each tab sharing a common perimeter edge with the end panel defined by a fold line between the end panel and the tab; and wherein each of the plurality of tabs is postured to align with at least one of the eight planar panels with the eight planar panels folded to form a closed perimeter octagonal main tubular portion of the container.

BRIEF DESCRIPTION OF THE SEVERAL VIEWS OF THE PHOTOGRAPHS/DRAWINGS

The foregoing summary as well as the following detailed description of the preferred embodiment of the invention will be better understood when read in conjunction with the appended drawings. It should be understood, however, that the invention is not limited to the precise arrangements and instrumentalities shown herein. The components in the drawings are not necessarily to scale, emphasis instead being placed upon clearly illustrating the principles of the present invention. Moreover, in the drawings, like reference numerals designate corresponding parts throughout the several views.

The invention may take physical form in certain parts and arrangement of parts. For a more complete understanding of the present invention, and the advantages thereof, reference is now made to the following description taken in conjunction with the accompanying drawings, in which.

DETAILED DESCRIPTION OF THE INVENTION

Figure 1:
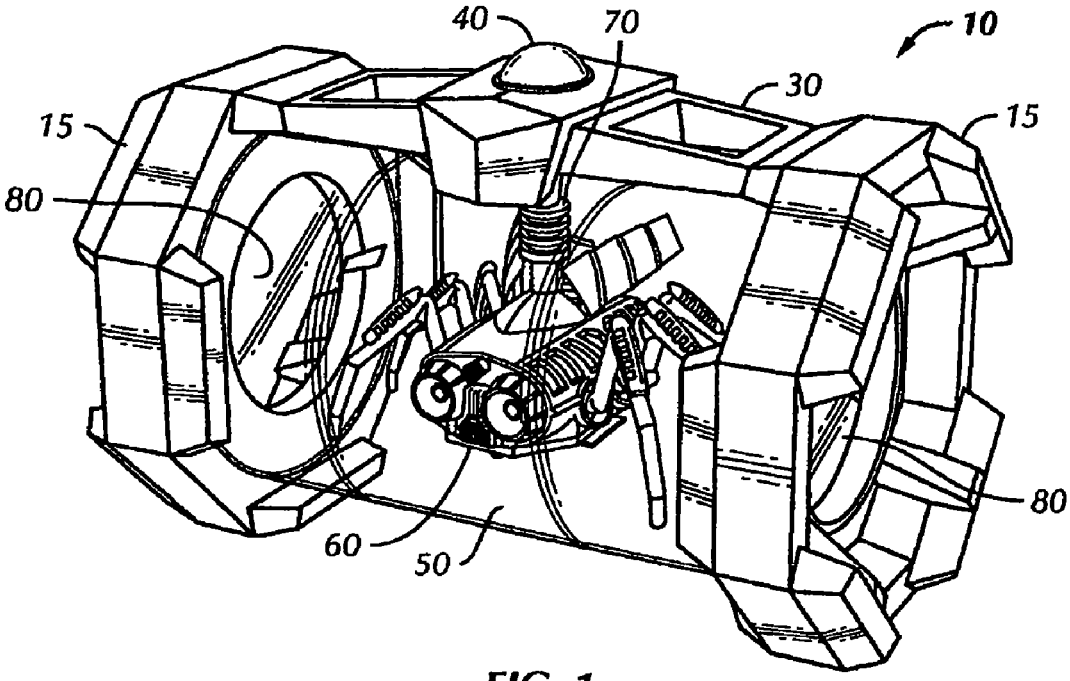
FIG. 1 is a front-side perspective view of a container device assembly being depicted as housing a radio controlled toy in accordance with a preferred embodiment of the present invention.

The following discussion is presented to enable a person skilled in the art to make and use the invention. The general principles described herein may be applied to embodiments and applications other than those detailed below without departing from the spirit and scope of the present invention as defined by the appended claims. The present invention is not intended to be limited to the embodiments shown, but is to be accorded the widest scope consistent with the principles and features disclosed herein.

Certain terminology is used in the following description for convenience only and is not limiting. The words "right," "left," "lower" and "upper" designate directions in the figure to which reference is made. The words "inwardly" and "outwardly" refer to directions toward and away from, respectively, the geometric center of the device and designated parts thereof. The terminology includes the words specifically mentioned, derivatives thereof and words of similar import. Additionally, the word "a" as used in the specification means "at least one."

Referring now to the drawings in detail, wherein like numerals indicate like elements throughout, there is shown in FIGS. 1-5 a first embodiment of a container assembly (or simply "container") 10 for preferably, but not exclusively housing a mechanically active toy 60 such as remote or radio controlled (R/C) toy illustrated in the form of a creature (also 60) suspended from a rigid suspension or support member 70 while simultaneously providing a display active functionality of the feature(s) of the housed toy creature, preferably by way of a control pad 40 integrally disposed on a portion of the container assembly 10.

With reference to FIG. 1, the preferred embodiment of the container assembly 10 of the present invention comprises a plurality of container members including, but not limited to, a main tubular portion 50 having a pair of opposing open ends and a pair of octogonal shaped end covers 15, preferably in the form of individual end caps (also 15). The container assembly 10 further includes a rigid beam member 30 extended between the pair of octogonal end covers 15 along a side of the elongated tubular portion so as to provide a large central open area indicated generally at 52 within the elongated tubular portion 50 and between the end covers 15. The container assembly 10 further includes the rigid support member 70 extended transversely from the rigid beam member 30 into the large central open area 52 within the elongated tubular portion 50 so as to support the toy creature 60 for observation and at least limited operation in the large central open area 52 of the closed container assembly.

To that end, the elongated tubular portion 50 is this embodiment 10 is preferably formed of a polymer material by a tube of an appropriate transparent polymer material. Each end cover 15 is provided by molding and is preferably formed with a relatively large central aperture 80 therethrough so that the contained toy 60 can be seen from virtually all sides. The transparent tube 50 securely seats with each of the two removable end caps 15, thereby forming a secure, yet see through, containment environment for the enclosed toy 60 or other desired device.

The word "tubular" in the phrase "elongated tubular portion is defined as encompassing elements having a transverse cross-section with closed perimeter defined by five or more planar sides up to a fully curvilinear closed perimeter, which is to be considered to constitute an infinite number of infinitesimally small, adjoining planar sides rather than no planar sides.

The toy 60 is removably attached to the rigid support member 70 that is connected to the rigid beam member 30. Such attachment to the rigid support member 70 permits user interactivity with the remote controlled toy 60 by way of a handheld remote control unit (not shown but otherwise provided in the container assembly 10 with the toy 60,) or by way of the control pad 40 mentioned above, wherein the control pad 40 is provided on an exterior portion of the rigid beam member 30 and is interactive with the toy 60.

The integrally formed control pad 40 comprises control functionality electronics and devices for permitting user interactivity with a toy creature 60 suspended from the rigid suspension member 70. Specifically, the control pad 40 electronics provide functionality for moving the toy creature's 60 various legs, arms, body, eyes, feet and any other desired features. One skilled in the art will understand that although the present preferred embodiment discloses use of the container assembly 10 with a toy creature 60, such as an insect or the like, it is readily apparent that a plurality of devices can be contained or displayed for functionality without departing from the scope and spirit of the present invention.

Figure 2:
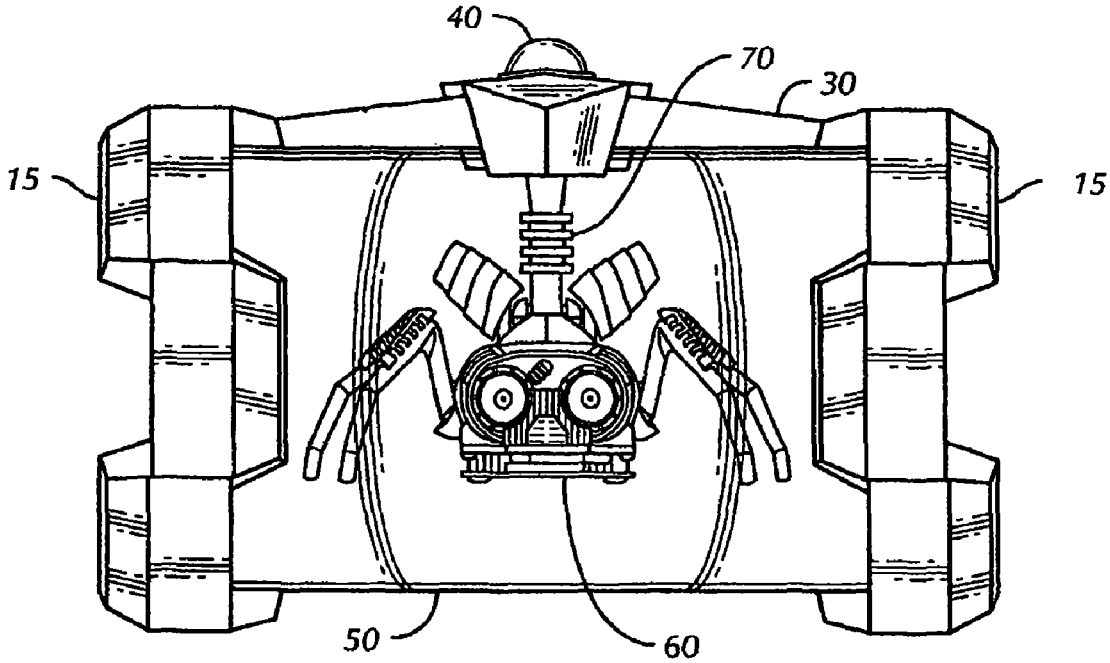
FIG. 2 is a front-side elevational view of the container device assembly as shown in FIG. 1.
Figure 3:
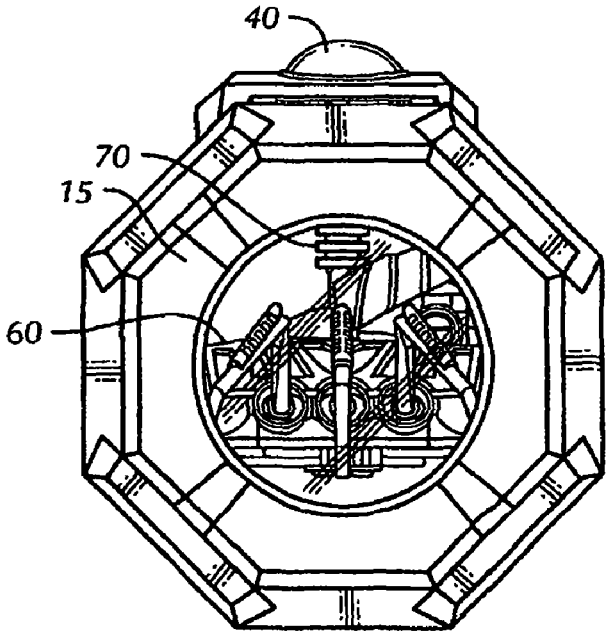
FIG. 3 is an end view of the of the container device assembly as shown in FIGS. 1 and 2.
Figure 5:
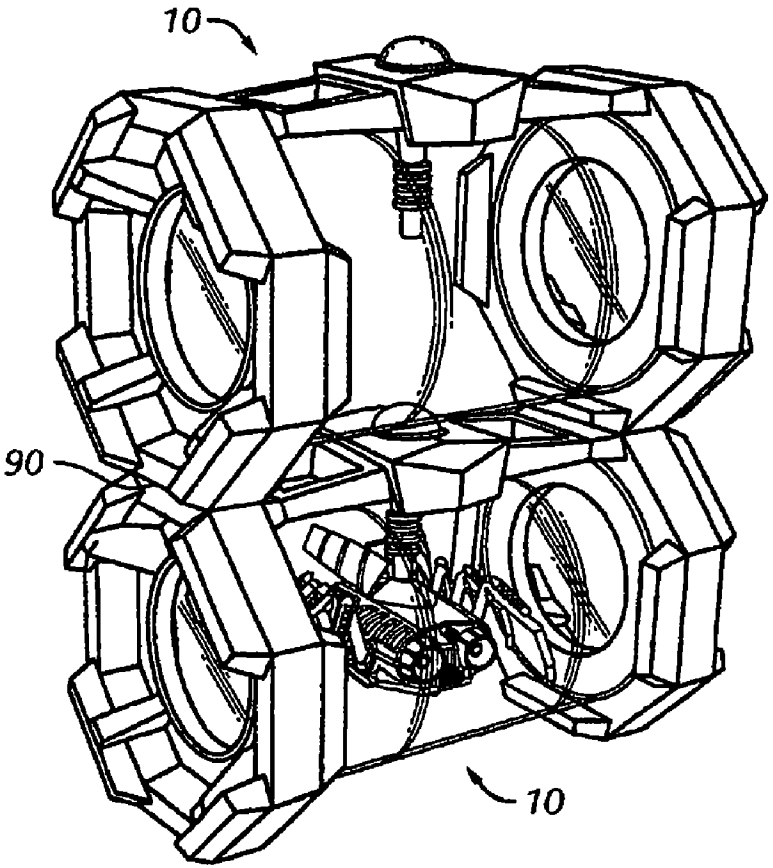
FIG. 5 is a perspective view of a pair of stacked container device assemblies as shown in FIGS. 1-4.
Figure 4:
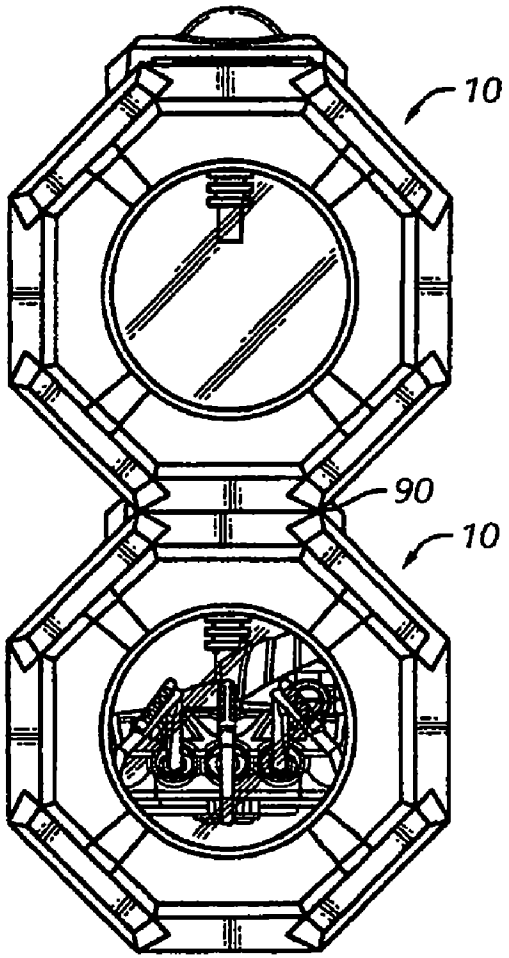
FIG. 4 is an end view of a pair of stacked container device assemblies as shown in FIGS. 1-3.

With specific reference to FIGS. 4 and 5, the container assembly 10 further serves as a method and device for safely and securely storing the contained toy creature 60, or the like, in either a single (as shown in FIGS. 1-3) or a multi-stacked configuration (as shown in FIGS. 4-5), wherein the multi-stacked configuration at least two container assemblies 10 are adjacently positioned together along an attachment portion 90.

The container assembly 10 of the preferred embodiment is preferably formed of, but not limited to, polymeric materials, or the like, having a minimum number of parts which can be assembled and used with ease and of relatively low cost. As shown in FIGS. 2 and 3, by way of example, the overall length of the embodiment depicted is 10.9 inches and the general height is 6.5 inches. However, although such exact dimensions are depicted in FIGS. 2 and 3, the dimensions are not meant to be limiting in nature. Specifically, the length and width and height can vary depending upon the toy creature's 60, or other device, overall size and shape. In addition, the specific shape of the embodiment shown in the Figs. is only one example of geometric shapes that is contemplated by the present invention. Therefore, one skilled in the art will understand that a plurality of shapes and sizes of the container assemblies 10 is possible without departing from the scope and spirit of the present invention.

As stated above, the toy creature 60 is preferably used in combination with a conventional wireless remote controller (not shown), wherein the controller is activated by an operator preferably via an on/off switch (not shown). The toy creature 60 is provided with conventional control electronics adapted to control operation of various anatomical features of the toy creature 60.

It will be appreciated by those skilled in the art that changes could be made to the embodiment described above without departing from the broad inventive concept thereof. For example, although the invention is shown herein in terms of a single assembly or a two-stacked assembly embodiment, the present invention could also comprise any number of stacked assemblies each containing a different type of suspended remote controlled creature, or the like. The toy creature 60 is preferably controlled via radio (wireless) signals from the wireless transmitter (not shown). However, other types of controllers may be used including other types of wireless controllers (e.g. infrared, ultrasonic and/or voice-activated controllers) and even wired controllers and the like. The container assembly 10 can be constructed of, for example, plastic or any other suitable material such as metal or composite materials. Also, the dimensions of the container assembly 10 shown can be varied, for example making components of the container assembly 10 smaller or larger relative to the other components and in relation to the desired object for containment.

Figure 6:
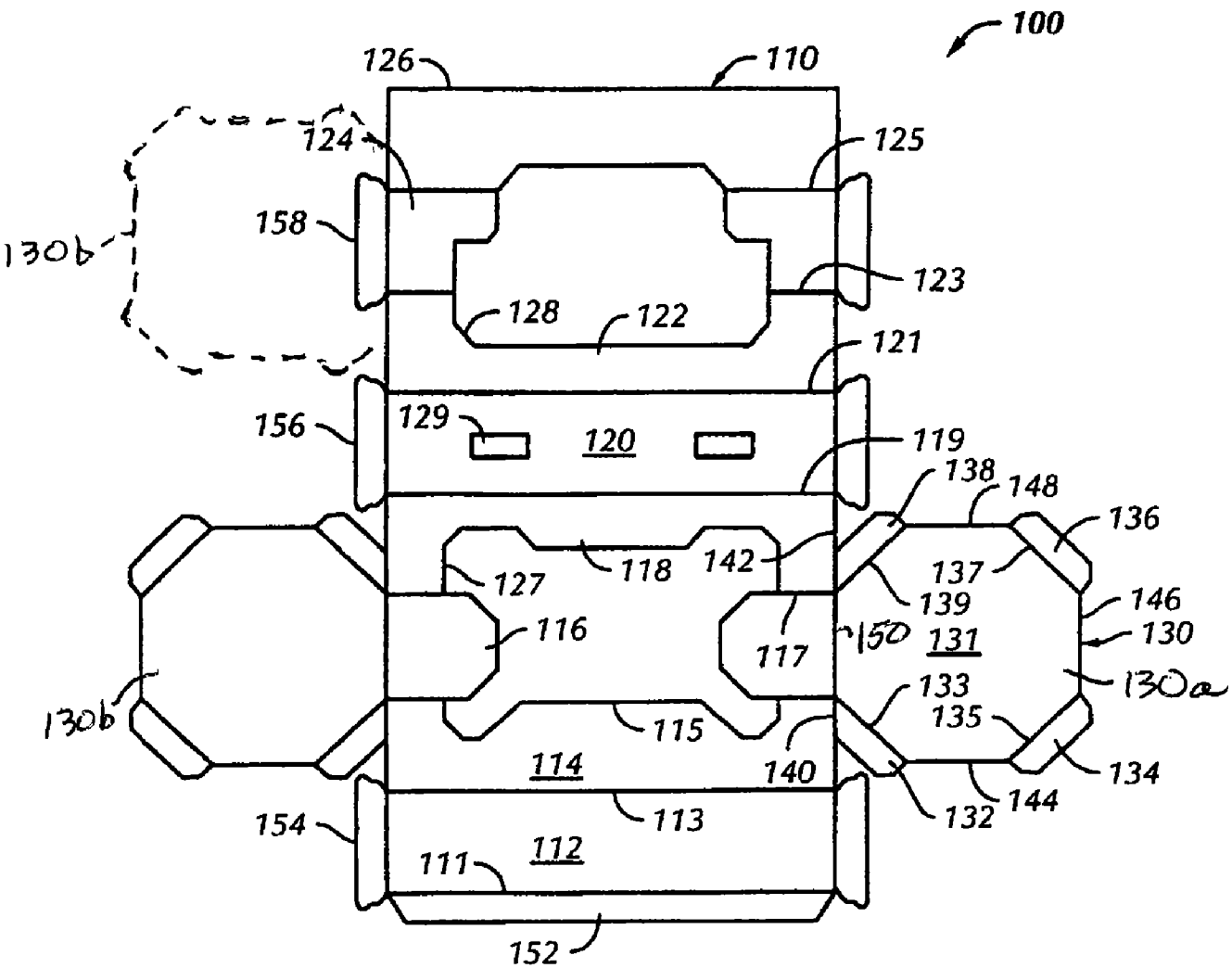
FIG. 6 is a plan view of a first blank for forming an octagonal carton.
Figure 7:
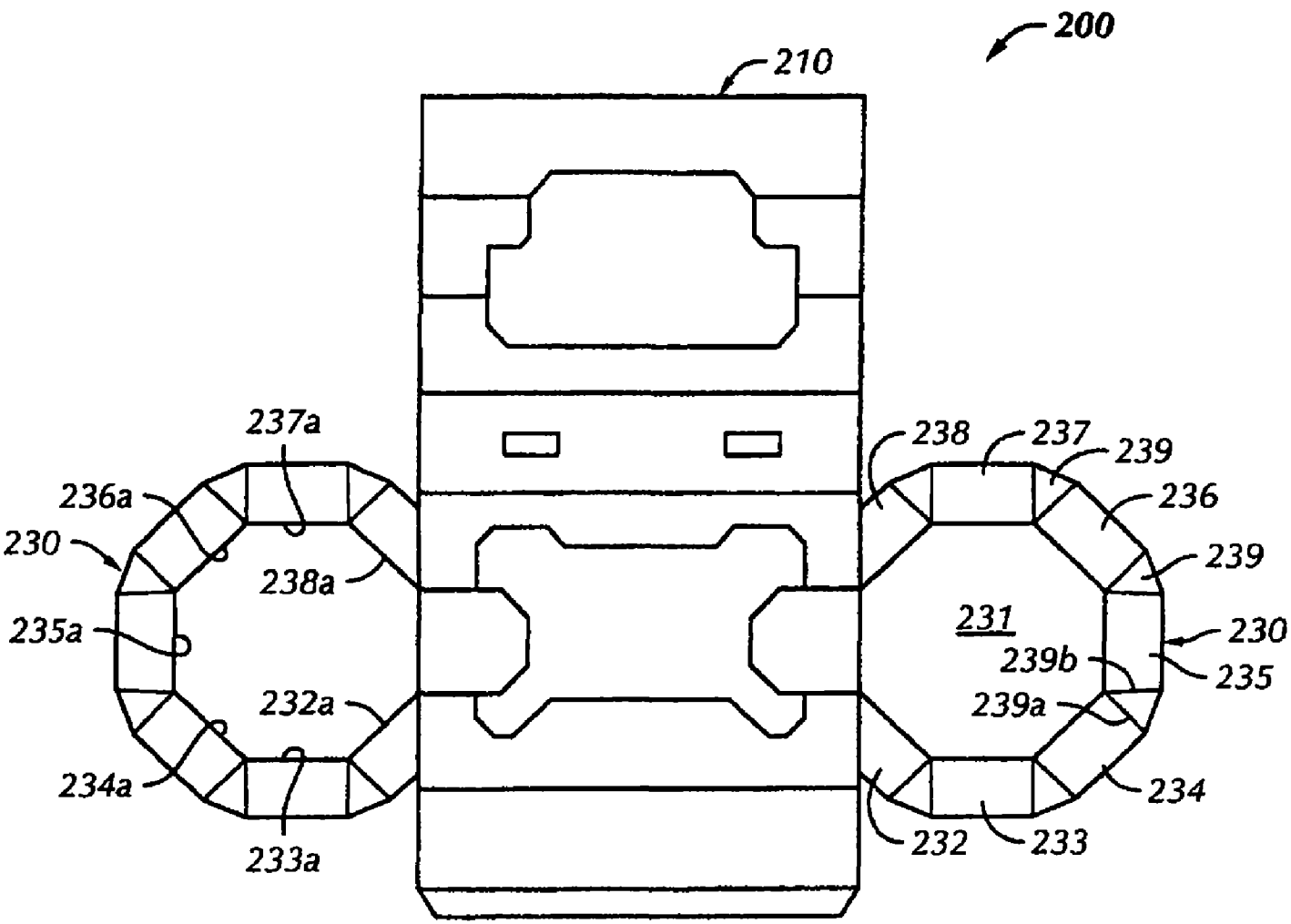
FIG. 7 is a plan view of a second blank for forming an octagonal carton.
Figure 8:
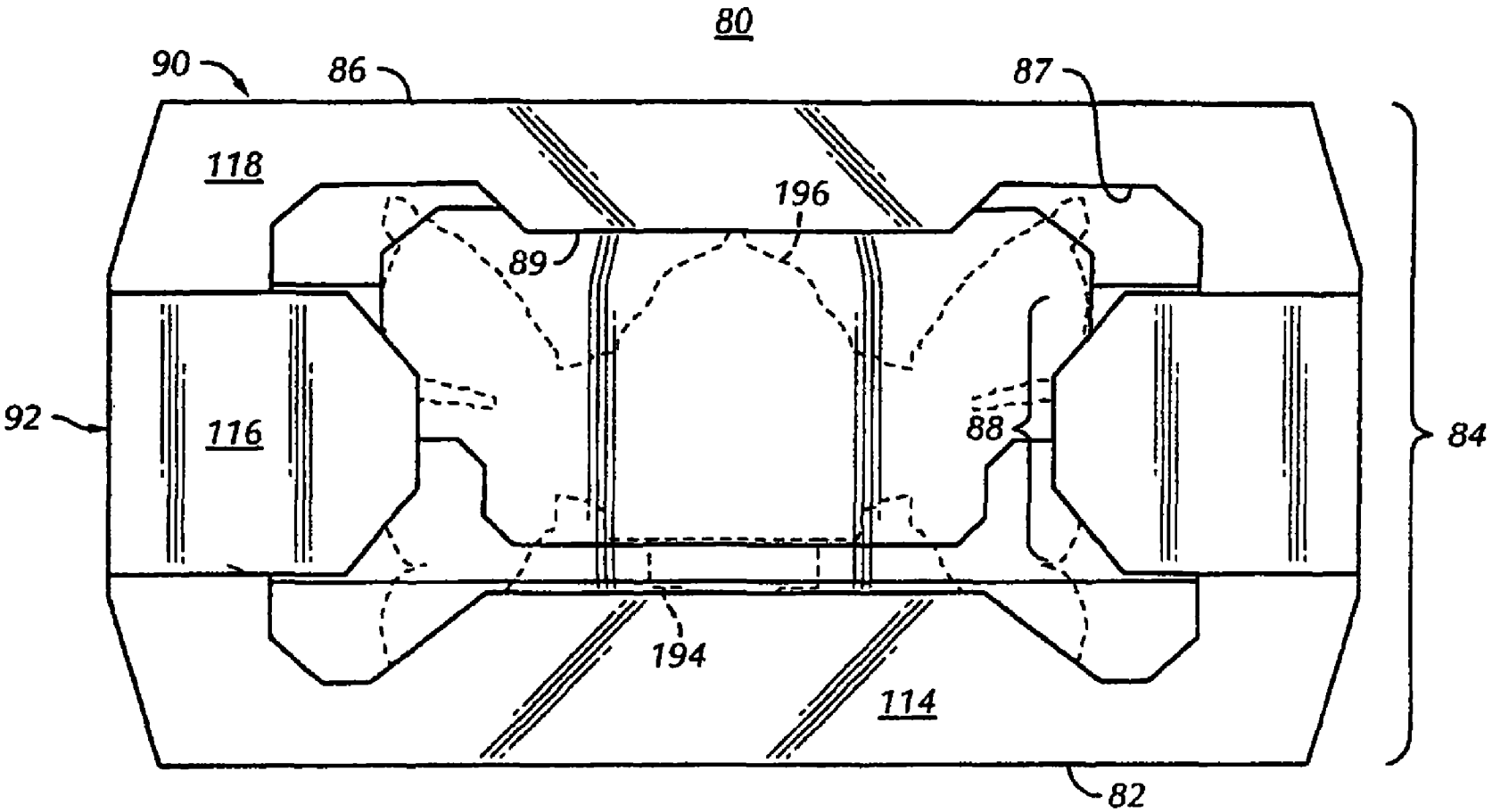
FIG. 8 is a perspective front view of a package made by either of the blanks of FIGS. 6 and 7.

It is understood, therefore, that changes could be made to the container assembly 10 described above without departing from the broad inventive concept thereof. For example, while FIGS. 1-5 depict one form of an octagonal container device assembly, FIGS. 6 and 7 show cut sheet blanks 100 and 200 that can each be made from a single sheet of conventional foldable stock material such as cardboard to provide as depicted in FIG. 8. While container 80 can be used by itself, more preferably it is used in a container assembly with an insert like insert 160 of FIG. 9.

Each cut sheet blank 100, 200, comprises a main tubular body portion 110, 210 defined by the same eight rectangular, sequential, planar panels 112, 114, 116, 118, 120, 122, 124 and 126 in consecutive side-by-side relation. Preferably they are all of the same outer dimensions but need not be so. Each rectangular planar panel has a pair of opposing minor edges extending between the major edges. Each consecutive pair of rectangular planar panels is defined by and separated from one another by and shares common or at least adjoining major edges defined by a series of fold lines 113, 115, 117, 119, 121, 123 and 125, respectively, that are preferably parallel to one another.

A first window cutout 127 is provided through parts of at least two and preferably three adjoining panels 114, 116 and 118. A second window cutout 128 is provided through parts adjoining panels 122, 124, 126. The window cutouts can be left open for access to the interior of the package of covered in a conventional fashion with transparent sheet stock cut to size. In any event, windows 127, 128 make the package/container 80 see through.

A closure tab 152 adjoins one outer panel 112 in side by side relation and shares with it a common major edges defined by a fold line 111 between the one outer panel 112 and the closure tab 152. The main tubular portion 90 of carton 80 is formed by folding the eight rectangular closure panels 112, 114, 116, 118, 120, 122, 124, 126 of either blank 100 or 200 into a tube with closure tab 152 overlapping another, opposing outer panel 126 of the eight rectangular panels and being secured in place with the other outer panel 126 by appropriate means, preferably a conventional, hot melt adhesive. Panel 112 preferably defines a base or bottom wall 82 of the package 80. Panels 114, 116 and 118 preferably collectively define a front wall 84 of the package 80. Panel 120 preferably defines a top or upper wall 86 of package 80 with a front window 87 formed by cutouts through at least two adjoining interior planar panels or, as in the present case, through these three planar panels 114, 116, 118. Remaining panels 122, 124, 126 preferably collectively define a back or rear wall 88 of package 80 with a rear window 89 formed by cutouts through those interior planar panels. While panel 112 is preferably the bottom wall, the package 80 could be rotated 180 degrees such that panel 112 is on top and 120 is on the bottom. Smaller cutouts 129 are optionally provided in panel 120 when it forms the top wall of package 80 to attach a carrying handle or secure an item in the package 80 to the top wall. Alternatively, cutouts 129 could be provided in the bottom wall 82 of the package 80 so secure something in the package 80 to the bottom of the package 80.

Blank 100 has a pair of mirror image end panels 130 defining a pair of mirror image end covers 92 of the package 80. First end panel 130*a* extends laterally outwardly from one minor edge of one rectangular panel 116. The first end panel 130*a* and the one rectangular panel 116 share common edges defined by fold line 150. While the first and second end panels 130*a*, 130*b* extend from opposite lateral sides and minor edges of the same rectangular panel 116, they could extend from lateral sides and minor edges of different rectangular panels as indicated in phantom at 130*b*'. Blank 200 also has a pair of mirror image end panels 230 of a different configuration from the end panels 130 but also defining a pair of mirror image end covers of the package 80 having the same appearance as end covers 92, are least when the covers are closed.

Referring to FIG. 6, each of the end panels 130 has a central panel portion 131, which forms the visible portion of end cover 92 on package 80, and which is surrounded by four end panel tabs 132, 134, 136 and 138. Tabs 132, 134, 136 and 138 are formed by protrusions on the central panel portion 131 extending outwardly at uniform (e.g. ninety degree) positions around central panel portion 131 and by fold lines 133, 135, 137 and 139, respectively between each tab 132, 134, 136 and 138 and the central panel portion 131. Fold line 133, 135, 137, 139 define an alternate four of eight consecutive perimeter edges of central panel portion 131. Additional score lines 140 and 142 define and separate tabs 132 and 138 from rectangular panels 114 and 118, respectively. Adjoining tabs 132/134, 134/136 and 136/138 are separated by cutouts 144, 146 and 148, respectively, defining a remaining three perimeter edges with the same respective reference numbers.

Preferably, a second plurality of preferably identical tabs 154, 156 and 158 are provided extending laterally outwardly from opposite longitudinal ends and minor edges of rectangular panels 112, 120 and 124, respectively, and are defined by respective fold lines 155, 157 and 159. With the eight rectangular planar panels folded and formed into main tubular portion 90, each of the tabs 154, 156, 158 aligns with a cut out 144, 148, 146 respectively and an exposed permanent edge of the central panel portion (of the same reference number) defined by the cutout. Tabs 154, 156 and 158 are preferably wedged shaped to engage tabs 132, 134, 136 and 138 of the end panels 130 when tabs 154, 156 and 158 are inserted into the gaps in the end panel 130 formed by cutouts 144, 148 and 146 respectively.

Referring to FIG. 7, each of the end panels 230 has a central panel portion 231, which forms the visible portion of end cover 92 on package 80, and which is surrounded by a plurality, seven, preferably rectangular or at least right angle "tabs" 232, 233, 234, 235, 236, 237, and 238. Each of the aforesaid tabs 232-238 is defined in part and separated from the central panel portion 231 by respective fold lines 232*a*, 233*a*, 234*a*, 235*a*, 236*a*, 237*a*, and 238*a*. Adjoining pairs of the rectangular/right angle tabs 232/233, 233/234, etc., are defined and separated from one another by triangular or wedge shaped portions 239. Portions 239 can be cut entirely from the blank 200 along lines 239*a*, 239*b*. Alternatively, any triangular portion 239 can be cut along one line 239*a* or 239*b* and folded along the other to overlap one or the other of the two rectangular/right angle pair of tabs flanking and defined by the particular triangular tab. The end panels 130, 230 can be secured with the main body 110 by mechanical interfit, conventional securement(s) such as hot melt adhesive or both. Tabs 232-238 adjoin rectangular planar panels, 114, 112, 126, 124, 122, 120 and 118, respectively when container 80 is formed from the planar panels.

Figure 9:
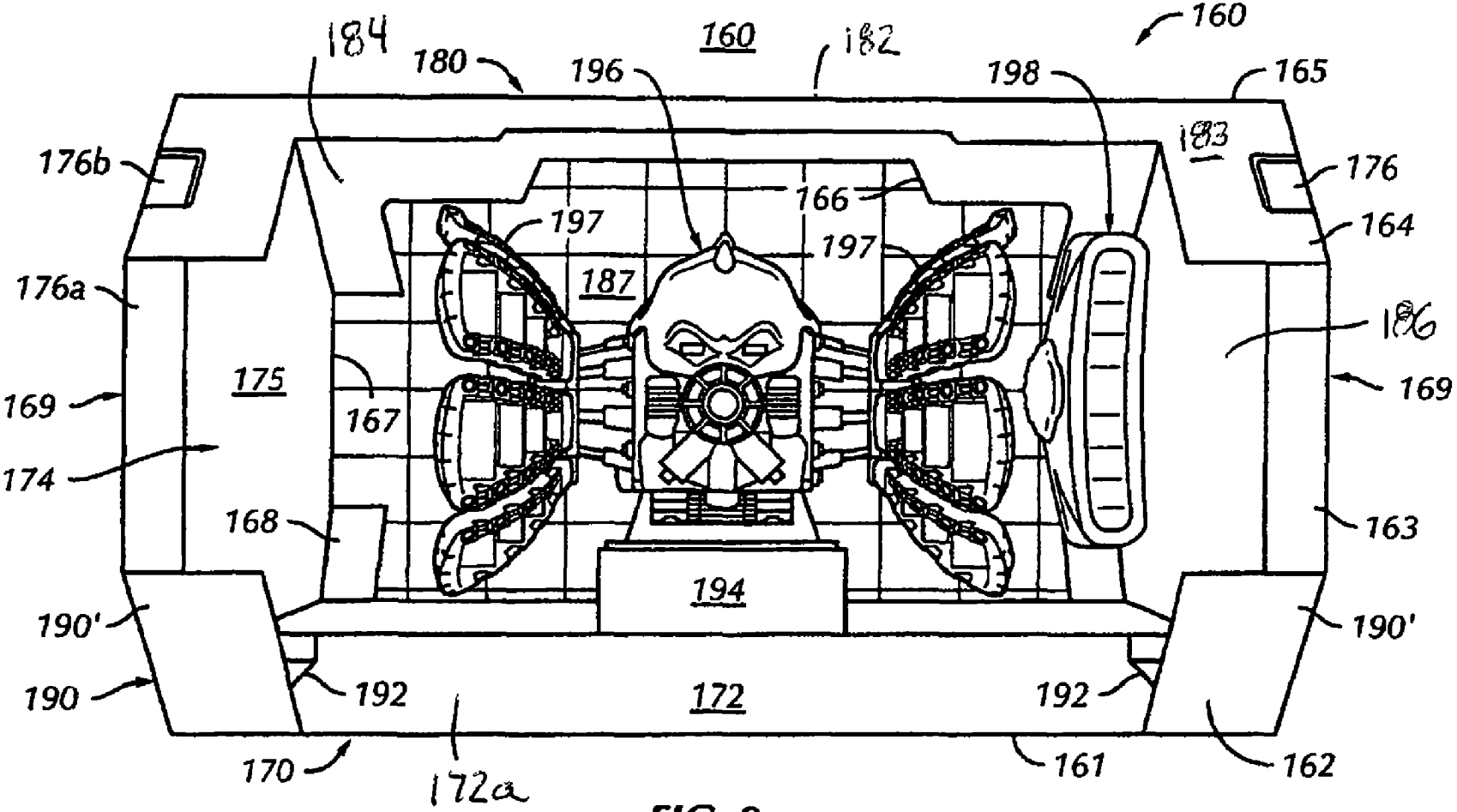
FIG. 9 is another product insert for the cartons of FIGS. 6-8.

FIG. 9 depicts one version of a container insert of the present invention indicated generally at 160, which is intended to be used in combination with container 80 in a container device assembly. Insert 160 is a multipiece assembly made from at least two and suggestedly at least three separate cut and folded sheet blank members 170, 180 and 190 that can also be made from conventional foldable stock material such as cardboard. Insert 160 has a generally tubular body defined by eight adjoining generally planar sides 161 through 168, respectively, forming a generally octagonal main body, and two, mirror image ends 169.

The first blank member 170 is cut and folded to form a C beam 172 with the opening facing downward or a box beam. The beam 172 extends along the base side 161 of insert 160 between the ends 169. Mirror image cut end portions 174 are folded up and inward from opposite ends of beam 172 to form the ends 169. Each end portion 174 has an octagonal center panel 175 the sides of which are defined by a plurality of tabs 176, (two of which are numbered 176*a*, 176*b* on either end), which are folded outwardly from the octagonal center panel 175 to define the octagonal center panel 175. End portions 174 can be octagonally shaped in the same way octagonal end panels 230 are formed.

Second blank member 180 connects the ends 169 together opposite beam 172. A center panel portion 182 defines the top side 165 of the insert 160 while side panel portions 183 and 184 extend down form center panel portion 182 to form planar partial sides 164 and 166 flanking the top side 165. Preferably side panel portions 183 and 184 extend the entire length of the insert and connect with tabs 176*a* on the front and like tabs (hidden) on the rear of the end panels for greater rigidity and strength.

Third blank member 190 can assume a variety of configurations including one substantially mirroring second member 180 to extend entirely across/along the insert 160 between the ends 169 and lapping the tabs that might be provided on each end portion 174 on either side of the beam 172. More preferably, two mirror image members 190' are provided, one at either end 169. Each member 190' would preferably span the bottom open side of the beam 172 at either end 169 and lap the tabs provided on the end portions 174 on either side of the beam 172. If desired, members 190' can be cut and folded to double over and form cross struts 192 that extend inwardly against and are joined with a front face 172*a* of the beam 172. Similar cross struts can be provided on the hidden (rear) side of the insert 160, if desired. This construction provides large front and rear openings 186 and 187, respectively, which together define a large open central area in the insert and thus in the container assembly.

Beam 172 preferably provides a rigid member to support a transversely rigid extending support member in the form of a pylon 194 in the bottom center of the insert 160 extending into the large open central area formed by between insert ends 169, beam 172 and members 180, 190. A toy 196, particularly one with movable appendages 197 such as wheels as shown and/or limbs is removably secured to the top of the pylon 196 with its appendages 197 suspended away from the sides of the insert 160. In this way, the appendages 197 can be made to move while the toy is in the package. A manually operated, remote control transmitter 198 can also be provided and secured in a conventional way (such as with wire(s) or cable tie(s)) to the insert 160. The octagonal insert 160 is then received in octagonal package 80 (FIG. 8), where the toy 196 mounted on the pylon 194 supported on the beam 172 is depicted in phantom.

Octagonal container assemblies have been described which permit at least limited visible operation of a contained product. Described octagonal container assemblies provide an unusual, attractive appearance yet permit stacking at least as stable and efficient as ordinary rectangular packaging. Although the invention has been shown and described with respect to a certain preferred and other embodiments, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention.

It is understood, therefore, that this invention is not limited to the particular embodiment disclosed, but is intended to cover modifications within the spirit and scope of the present application. It is therefore, contemplated that the claims will cover any such modifications or embodiments that fall within the true scope of the invention.

What is claimed is:

1. An octagonal container comprising:

an main tubular portion having opposing open ends;

a pair of octagonal shaped end covers configured to be received on the open ends so as to close the open ends;

a rigid beam member extended between the pair of octagonal end covers along a side of the elongated tubular portion so as to provide a large central open area within the elongated tubular portion; and a rigid support member extended transversely from the rigid beam member into the large central open area within the elongated tubular portion;

the main tubular portion and the pair of octagonal shaped end covers being formed together in one piece from a single sheet blank of foldable stock material;

the rigid beam member being formed from a second sheet blank of foldable stock material separate from the single sheet blank of foldable stock material forming the main tubular portion and the pair of octagonal shaped end covers;

the second sheet blank of foldable stock material forming the rigid beam member being part of a container insert, the second sheet blank of foldable stock material including a pair of mirror image end portions folded up and inward from opposite ends of the rigid beam to define longitudinal ends of the insert; and further comprising a third sheet blank of foldable stock material separate from the single sheet forming the container and the second sheet blank forming the rigid beam and longitudinal ends, the third sheet blank being connected with the longitudinal ends of the insert so as to hold the longitudinal ends in the folded condition.

2. The octagonal container of claim 1 wherein the single sheet blank of foldable stock material includes:

eight planar panels in consecutive side by side relation, each of the panels being rectangular with a pair of opposing major edges and a pair of opposing minor edges extending between the major edges, each adjoining pair of the planar panels sharing common major edges defined by a fold line between the adjoining pair of the planar panels;

a closure tab adjoining one outer panel of the eight planar panels in side by side relation, the one outer panel and the closure tab sharing common major edges defined by a fold line between the one outer panel and the closure tab, the closure tab being secured with another outer panel of the eight planar panels such that the one common major edge of the one outer panel shared with the closure tab adjoins an exposed outer edge of the other outer panel such that the eight planar panels form an octagonal main tubular portion of the container;

a first end panel extending from the minor edge of one of the eight planar panels, along one side of the eight planar panels and forming a first end cover; and a second end panel extending from the minor edge of one of the eight planar panels, along another side of the eight planar panels opposing the one side with the first end panel and forming a second end cover.

3. The octagonal container of claim 2 wherein each of the first and second end panels comprises an octagonal central portion with eight consecutive perimeter edges, each central portion being surrounded by a plurality of end panel tabs, each end panel tab sharing a common perimeter edge with the octagonal central portion defined by a fold line between the octagonal central portion and the tab, and wherein each of the plurality of end panel tabs is configured to align with at least one of the eight planar panels with the eight planar panels folded to form the octagonal main tubular portion.

4. The octagonal container of claim 2 further comprising a second plurality of tabs extending laterally outwardly from minor edges of a plurality of the eight planar panels, each of the second plurality of tabs sharing edges with one of the plurality of eight planar panels defined by a fold line between the tab and the planar panel.

5. The octagonal container of claim 2 further comprising at least one window cut-out formed through at least two adjoining planar panels of the eight planar panels other than the one and the other outer panels.

6. The octagonal container of claim 1 wherein the rigid beam member extends between the pair of octagonal end covers within the main tubular portion.

7. The octagonal container of claim 1 in combination with a mechanically active toy supported by the rigid support member within the large central open area for at least limited movement operation of the toy.

8. A single sheet of foldable stock material configured to form an octagonal container comprising:

eight planar panels in consecutive side by side relation, each of the panels being rectangular with a pair of opposing major edges and a pair of opposing minor edges extending between the major edges, each consecutive pair of planar panels sharing common major edges defined by a fold line between the pair of planar panels;

a closure tab adjoining one outer panel of the eight planar panels in side by side relation, the one outer panel and the closure tab sharing common major edges defined by a fold line between the one outer panel and the closure tab;

a first end panel extending from the minor edge of one of the eight planar panels, along one side of the eight planar panels; and a second end panel extending from the minor edge of one of the eight planar panels, along another side of the eight planar panels opposing the one side with the first end panel;

wherein each of the first and second end panels comprises an octagonal central portion with eight consecutive perimeter edges, each of the central portions being surrounded by a plurality of tabs, each tab sharing a common perimeter edge with the central portion of the end panel defined by a fold line between the central portion of the end panel and the tab, and wherein each of the plurality of tabs is positioned to align with at least one of the eight planar panels with the eight planar panels folded to form a closed perimeter octagonal main tubular portion of the container, each of the first and second end panels including seven tabs, and each of the first and second end panels further including a wedge shaped portion of the stock material between adjoining pairs of tabs.

9. The foldable stock material of claim 8 wherein the eight planar panels have equal dimensions along the major edges and equal dimensions along the minor edges.

10. The foldable stock material of claim 8 further comprising at least one window cut-out formed through at least two adjoining planar panels.

11. The foldable stock material of claim 10 further comprising at least a second window cut-out formed through at least two adjoining planar panels, the second window cutout being spaced from the one window cutout by at least one intervening planar panel.

12. The foldable stock material of claim 8 further comprising at least one window cut-out formed through at least three adjoining planar panels.

13. The octagonal container of claim 3 wherein each of the first and second end panels includes less than seven end panel tabs.

14. The octagonal container of claim 13 wherein each of the first and second end panels includes only four spaced apart end panel tabs.

15. The octagonal container of claim 3 wherein each of the first and second end panels includes seven end panel tabs.

16. The octagonal container of claim 3 wherein each of the first and second end panels further includes a wedge shaped portion of the stock material between adjoining pairs of end panel tabs.

17. The octagonal container of claim 1 wherein the container insert includes a rigid support member extended transversely from the rigid beam member into a central open area between the longitudinal ends of the insert so as to receive and space a toy with moving components sufficiently far away from the rigid beam so as to operate the components without interference from the rigid beam.

* * * * *